US006478110B1

(12) United States Patent
Eatwell et al.

(10) Patent No.: US 6,478,110 B1
(45) Date of Patent: Nov. 12, 2002

(54) VIBRATION EXCITED SOUND ABSORBER

(76) Inventors: Graham P. Eatwell, 6 Southgate Ct., Annapolis, MD (US) 21401; Ralph Busch, 12917 Climbing Ivy Dr., Germantown, MD (US) 20874

( * ) Notice: Subject to any disclaimer, the term of this patent is extended or adjusted under 35 U.S.C. 154(b) by 0 days.

(21) Appl. No.: 09/523,975

(22) Filed: Mar. 13, 2000

(51) Int. Cl.[7] ..... F06F 15/00
(52) U.S. Cl. ..... 181/207; 181/208; 181/209
(58) Field of Search ..... 181/207, 208, 181/209, 286, 290, 295

(56) References Cited

U.S. PATENT DOCUMENTS

| | | | | |
|---|---|---|---|---|
| 4,025,724 A | | 5/1977 | Davidson et al. | |
| 4,149,612 A | | 4/1979 | Bschorr | |
| 4,373,608 A | | 2/1983 | Holmes | |
| 4,435,751 A | | 3/1984 | Hori | |
| 4,442,647 A | | 4/1984 | Olsen | |
| 4,525,791 A | | 7/1985 | Hagiwara et al. | |
| 4,600,078 A | | 7/1986 | Wirt | |
| 4,715,559 A | | 12/1987 | Fuller | |
| 4,930,113 A | | 5/1990 | Sallas | |
| 5,245,664 A | | 9/1993 | Kinoshite et al. | |
| 5,315,661 A | | 5/1994 | Gossman et al. | |
| 5,381,381 A | | 1/1995 | Sartori et al. | |
| 5,410,607 A | | 4/1995 | Mason | |
| 5,519,637 A | | 5/1996 | Mathur | |
| 5,621,656 A | | 4/1997 | Langley | |
| 5,642,445 A | | 6/1997 | Bucaro et al. | |
| 5,695,027 A | | 12/1997 | von Flotow et al. | |
| 5,710,714 A | | 1/1998 | Mercadal et al. | |
| 5,794,909 A | | 8/1998 | Platus et al. | |
| 5,804,775 A | | 9/1998 | Pinnington | |
| 5,873,559 A | | 2/1999 | von Flotow et al. | |
| 5,924,532 A | | 7/1999 | von Flotow | |
| 5,924,670 A | | 7/1999 | Bailey et al. | |
| 5,930,371 A | | 7/1999 | Cheng et al. | |
| 5,954,169 A | | 9/1999 | Jensen | |
| 6,006,875 A | | 12/1999 | van Namen | |
| 6,024,190 A | * | 2/2000 | Ritezma | 181/286 |
| 6,053,275 A | * | 4/2000 | Leonetti et al. | 181/200 |

OTHER PUBLICATIONS

O.Bschorr & E. Laudien, "The Silator—A Small Volume Resonator", Journal of Sound and Vibration, (1992), 158(1), 81–92.

G.P. Eatwell, "The Active Control of Transformer Noise", Proc. Inst. Acoust. (9) (7), 1987, p. 269.

M.J.M. Jessel, "Secondary Sources and their Energy Transfer", Acoustics Letters, 1981, vol. 4, No. 9.

Ross, Bradley W., Burdisso, Ricardo A. "Low Frequency Passive Noise Control of a Piston Structure with a Weak Radiating Cell", J. Acoust. Soc. Am. 106 (1), Jul. 1999, pp. 226–232.

Ross, Bradley W., "Attenuation of Low Frequency Structurally Radiated Noise with an Array of weak Radiating Cells", Master of Science Thesis submitted to Virginia Polytechnic Institute and State University, Feb. 1998.

* cited by examiner

*Primary Examiner*—Khanh Dang

(57) ABSTRACT

A vibration excited sound absorber for reducing the sound radiation from a vibrating surface. Each sound absorber has a radiating element which is connected to the vibrating surface by a coupling means. The vibrating surface is partially covered with one or more devices. The dynamic response of the sound absorber is tuned so that the volume velocity of the radiating element is substantially equal in amplitude but opposite in phase relative to the volume velocity of the surrounding exposed vibrating surface. The net volume velocity of the surface is thereby reduced.

23 Claims, 8 Drawing Sheets

VIBRATION EXCITED SOUND ABSORBER

TECHNICAL FIELD

This invention relates to the reduction of sound radiated from vibrating surfaces.

BACKGROUND ART

The prevention or attenuation of sound radiating from noisy equipment is a continuing problem. There are many techniques known in the prior art, each having its own merits and limitations. Some of the known techniques and their limitations are described below.

Barriers

The mechanical impedance of a barrier is the ratio of an applied force to the resulting vibration velocity. For a given applied force, a higher mechanical impedance will result in a lower vibration velocity, and hence a lower level of radiated sound. A sound barrier is therefore designed to have a high mechanical impedance. In traditional sound barriers this is achieved by using structures with high mass and/or high stiffness. The concrete walls alongside highways, which are both massive and stiff, are an example of this kind of barrier. The barriers must be relatively tall because diffraction, thermal shear and wind shear allow the sound to leak around the barrier. When the noise source is stationary, an alternative is to put the barrier close to the noise source, but this is often impractical because access may be required or because the presence of the barrier prevents heat loss and may cause the machine to overheat. When the barrier completely contains the noise source it is referred to as an enclosure. A light weight acoustic enclosure is described in U.S. Pat. No. 5,804,775 (Pinnington), for example.

An alternative method for obtaining a barrier, which has a high impedance at specified discrete frequencies, is described in U.S. Pat. No. 4,373,608 (Holmes). This uses mechanical resonators distributed over the surface of a sound barrier to provide a high impedance at the resonance frequency.

A still further approach, disclosed in U.S. Pat. No. 4,600,078 (Wirt), uses acoustic resonators inside a double-leaf barrier to increase the compliance of the enclosed volume.

Vibration Control

Vibration control seeks to control the vibration of the noise source directly. For a vibrating machine, this is done by increasing the mechanical impedance of the machine structure. One way to do this is by adding mass and/or stiffness to the vibrating structure.

A further method is to use mechanical resonators, as also described in U.S. Pat. No. 4,373,608 (Holmes). The resonators can be attached directly to the surface of a vibrating machine. An example of this type of control is a tuned dynamic absorber. These have been used successfully to reduce noise inside aircraft.

A still further method into use an active vibration control system. Examples include U.S. Pat. No. 4,435,751 (Hori), U.S. Pat. No. 4,525,791 (Hagiwara et al), U.S. Pat. No. 4,715,559 (Fuller) and U.S. Pat. No. 5,519,637 (Mathur). This method uses force actuators to apply forces to the vibrating surface, and thereby increase its apparent mechanical impedance.

In practice, many machines are already very high impedance structures excited by large forces. Often it is not possible to obtain much change in the combined impedance. Consequently it is difficult to reduce effectively the vibration and resulting sound radiation.

Active vibration control may also be attempted by using piezo-electric patches applied to the surface of the vibrating structure. These can be used to control bending of the structure, but do not prevent sound radiation by planar motion of a surface.

Further disadvantages of this method include the need for acoustic sensors to monitor the performance of the system and the need for a power supply. These add to the cost and complexity of the system.

Vibration Isolation

The simplest example of vibration isolation is a resilient machinery mount. When the frequency of the source of vibration (e.g. the rate of rotation of a motor) is significantly above the resonance frequency of the machine itself on its mounts, the foundation is isolated from the vibration of the machine. Another example is a double-leaf partition wall, which comprises two relatively high impedance panels separated by a low impedance intermediate layer (which is often air). Above the resonance frequency, the inertia of the radiating panel is much higher than the force required to compress the intermediate layer, so little vibration is transmitted to the radiating panel.

A further approach, disclosed in U.S. Pat. No. 5,315,661 (Gossman et al.), uses active control to isolate the outer leaf of a panel.

A further example is provided by U.S. Pat. No. 4,442,647 (Olsen). This uses a resonant device to reduce the radiation from a fuselage wall into a helicopter cabin.

Vibration isolation is often unsuitable for reducing the sound radiated from vibrating machinery, since it is often impractical to completely enclose the machinery because of access and cooling requirements.

Modification of Acoustic Impedance

Devices which have a low impedance (relative to the fluid medium into which the sound radiates) can be used to modify the acoustic impedance and thereby alter the sound field. Examples include Helmholtz resonators and mechanical resonators. U.S. Pat. No. 4,149,612 (Bschorr) and an associated paper 'The Silator—A Small Volume Resonator', O. Bschorr and E. Laudien, Journal of Sound and Vibration (1992), 158(1), 81–92, describe such a resonator. These are effective for controlling sound in a waveguide, where an impedance change can cause a reflection. However, they are of limited effectiveness in stopping radiated sound. Since the resonator is driven by the acoustic field, the sound cannot be cancelled, as there would then be nothing to drive the resonator. Instead, the resonator moves in quadrature (at 90° phase angle) to the acoustic field. Table 2 of the paper by O. Bschorr and E. Laudien indicates that the noise reduction is limited to 6 dB for wall emissions.

Active Sound Control

It is well known that the noise from a radiating surface can be reduced by placing secondary sources on or around the surface. See for example 'The Active Control of Transformer Noise', G. P. Eatwell, Proc. Inst. Acoust., 9(7), 1987, p269 and 'Secondary Sources and their Energy Transfer', M. J. M. Jessel, Acoustics Letters, Vol. 4, No. 9, 1981.

Active sound control uses computer controlled acoustic sources close to the primary noise source. The amplitude and phase of the sources is chosen so that the farfield radiated noise is reduced. Since the radiation pattern of the vibrating surface is seldom fixed, active control systems require acoustic sensors in the farfield to monitor performance and adjust the amplitude and phase of the controlled sources. This requirement adds significantly to the cost and complexity of the system and limits this technology to applications in which the noise source is acoustically compact or where very large costs can be borne. In addition, the complexity of the system necessitates regular maintenance, which further adds to the cost. Also, an active control system requires a power source, which complicates the installation process and is impractical in some applications. These features make active control systems expensive when compared to passive noise control methods.

There are many examples of this approach, including U.S. Pat. No. 4,025,724 (Davidson et al.) and U.S. Pat. No. 5,381,381 (Sartori et al.) which use near field acoustic sensors to provide reference signals, and U.S. Pat. No. 4,930,113 (Sallas), U.S. Pat. No. 5,245,664 (Kinoshite et al.), U.S. Pat. No. 5,410,607 (Mason) and U.S. Pat. No. 5,642,445 (Bucaro et al.) which use vibration sensors to provide reference signals.

Object of the Invention

Therefore, there is a need for a passive sound reduction system which (i) has low cost and high reliability (ii) can be applied to structures which have very high mechanical impedance (iii) allows for cooling and access to the structure and (iv) is easy to install. None of the methods of the prior art combines these properties,and it is accordingly an object of the invention to do so.

SUMMARY OF THE INVENTION

The vibration excited sound absorber of the current invention provides a method and apparatus for reducing the sound radiated from a vibrating surface into a surrounding fluid. The fluid may be liquid or gas. The apparatus has low cost and high reliability and can be applied to any structure, including structures which have a very high mechanical impedance. When applied directly to the surface of a machine, the apparatus only partially covers the structure and so allows for cooling and access. Multiple sound absorbers can be applied to any vibrating surface, including walls and existing barriers. The sound absorbers can also be incorporated in custom barriers. Unlike active noise control systems, no special skills are required to determine the positions for the sound absorbers. In one embodiment, the sound absorbers are simply attached to the vibrating surface, so the system can be easily retrofitted to operating equipment.

Examples of applications include power transformers, acoustic enclosures, acoustic barriers, aircraft fuselages etc.

The sound absorber has a radiating element and a coupling element which together have a tuned dynamic response. The coupling element couples the motion of the radiating element to that of the vibrating surface. The radiating element is thereby excited into motion by the vibration of the surface. The vibrating surface is partially covered with one or more sound absorbers. The dynamic response of the sound absorber is tuned so that acoustic volume velocity of the radiating element is substantially equal in amplitude but opposite in phase relative to the volume velocity of the surrounding exposed vibrating surface. The net volume velocity of the surface is thereby reduced. For example, if radiating elements cover 10% of the vibrating surface, preventing the covered portion from radiating sound, each radiating element must have a velocity nine times that of the vibrating surface, but in the opposite direction. The volume velocity of the radiating element then cancels the volume velocity of the remaining 90% of the vibrating surface. This is in contrast to vibration isolation, in which the aim is to make the volume velocity of the sound absorber as small as possible. Vibration isolation is only effective when the entire vibrating surface is covered.

The radiating element can be solid or fluid, and is coupled to the vibrating surface by a coupling element.

DETAILED DESCRIPTION OF THE INVENTION

Figure 1:
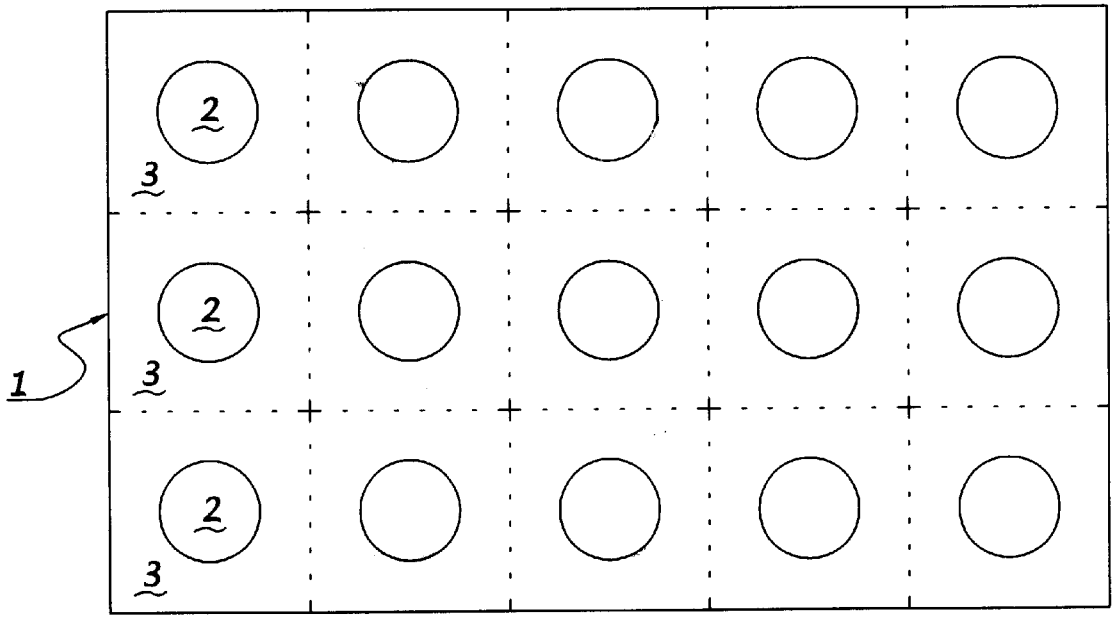
FIG. 1 is a diagram showing the manner in which, according to the invention, sound absorbers may be arranged with respect to a vibrating surface to attenuate sound radiated thereby.

As indicated above, the sound absorbers of the current invention are effectively coupled to a sound radiating surface and emit sound opposite in phase and equal in amplitude to that radiating by the surface, thus providing effective noise cancellation. The sound absorbers of the invention are placed in close proximity (relative to the wavelength of the sound to be cancelled) to the vibrating surface to be treated. In the preferred embodiment they are attached directly to the vibrating surface, but this is not a requirement. The area of vibrating surface surrounding each sound absorber defines a region or patch of the surface associated with that sound absorber. In one embodiment, the area of the vibrating surface which is closer to a particular sound absorber than any other sound absorber defines the region associated with that sound absorber. FIG. 1 shows an example of sound absorbers according to the invention and their associated regions. Preferably, the entire radiating surface is covered with contiguous regions. In FIG. 1 the vibrating surface 1 is partitioned into a number of contiguous regions 3. The dimension of each region is preferably less than one acoustic wavelength of the radiated sound. Sound absorbers 2 are positioned one in each region (except those regions where the surface vibration is relatively small). Regions of equal area are desirable so that a single design of sound absorber may be used, but this is not essential.

Figure 2A:
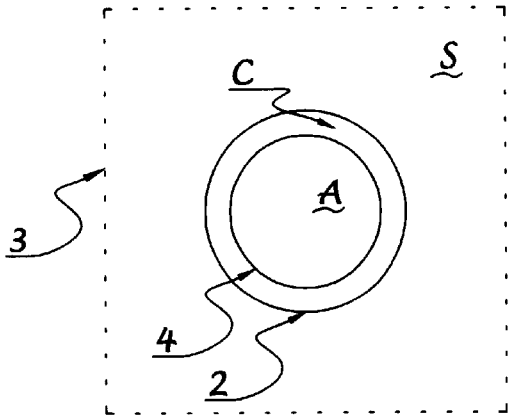
FIGS. 2*a* and 2*b* show diagrammatic representations of one embodiment of sound absorbers of the current invention.
Figure 2B:
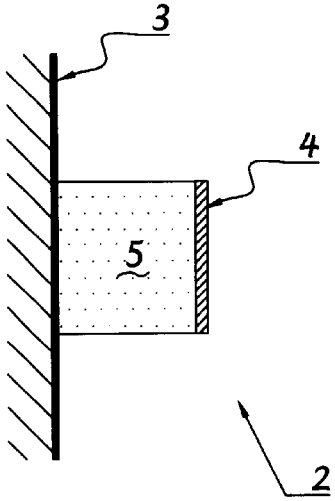
Figure 3A:
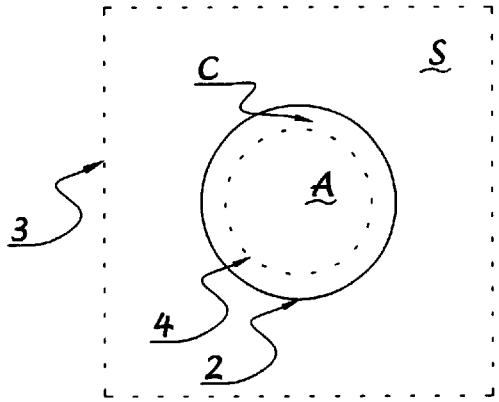
FIGS. 3*a* and 3*b* show diagrammatic representations of a second embodiment of the current invention.

We begin by modeling the sound radiated from a single sound absorber and its associated region. Referring to FIG. 2*a*, we consider a region 3 with vibrating surface S. The sound pressure at a point x away from the surface is given by $$p_0(x,w)=iw\rho_0\int_s G(x,y,w)u_0(y,w)dS \quad (1)$$

where G is the Green function which satisfies $$\frac{\partial G}{\partial n}=0$$

on the surface, n is the normal to the surface, w is the frequency in radians, $\rho_0$ is the density of the fluid (liquid or gas) into which the sound is radiated and $u_0(y,w)$ is the velocity of the surface at position y on the surface. This is one form of the Kirchhoff-Helmholtz integral equation. The vibrating surface S is assumed to be small compared to the acoustic wavelength, so the variation of the Green function over the surface can be neglected; this gives the approximation $$p_0(x,w)\cong H(x,ys,w)U_0(S,w), \quad (2)$$

where $$U_0(S,w)=\int_s u(Y,w)dS \quad (3)$$

is the volume velocity of the surface region and $$H(x,ys,w)=iw\rho_0 G(x,ys,w) \quad (4)$$

is a transfer function and $y_s$ is a mid point on the surface. In the system of the current invention, a region of the surface may be covered with the sound absorber. Referring to FIG. 2*a*, the sound absorber 2 covers a region with an area C and contains a radiating element 4 with surface area A. Referring to FIG. 2*b*, the radiating element 4 is oriented away from the surface 3. Apart from the radiating element, any remaining area of the sound absorber is assumed to be rigidly coupled to the vibrating surface, so in this configuration an exposed area S'=S−A moves with the vibrating surface. In the configuration shown in FIGS. 3*a* and 3*b*, the sound absorber 2 is mounted in rigid housing 6 displaced from the vibrating surface 3 by standoffs 7. In this configuration a total area S'=S+A moves with the vibrating surface. The radiating element 4 is coupled to the rigid housing 6 by coupling element 5. The radiating element is coupled to the vibration of the surface 3, through standoffs 7 and housing 6.

The orientation of the radiating element is not significant when the radiating element is small compared to a wavelength, since it approximates a monopole source.

In a further embodiment, the sound absorbers of the current invention are incorporated into the vibrating surface itself. The radiating elements may be mounted flush with the vibrating surface.

In a further embodiment, the housing and radiating element form an acoustically sealed volume, so that the coupling element includes a fluid spring. The housing may include a small aperture to allow for equalization of static pressure.

Figure 3B:
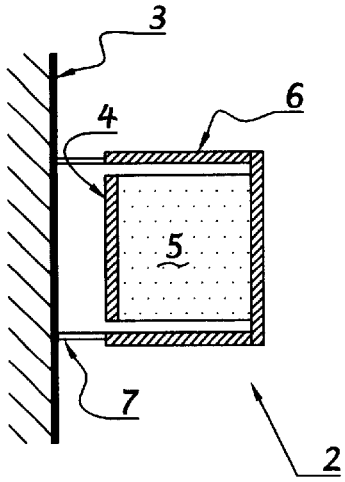

The radiating element is coupled to the motion of the vibrating surface 3, by coupling element 5, shown in FIGS. 2*b* and 3*b*. This coupling element 5 is not rigid and has a dynamic response. The overall response of the sound absorber 2 will depend upon the mass of the radiating element 4, the properties of the coupling element 5 and the external acoustic coupling with the vibrating surface.

In one embodiment, the coupling element 5 contains solid elastomer elements and may include mass elements.

The normal velocity $u_r$ of the radiating element 4 is related to the velocity of the vibrating surface by $$u_r(w)=T(w)\bar{u}_0(w), \quad (5)$$

where $\bar{u}_0(w)$ is the normal velocity of the vibrating surface 3 averaged across the attachment points and T(w) is the transmissibility of the sound absorber 2. Note that when the radiating element faces inwards, as shown, the direction of the normal is reversed, so the resulting transmissibility is also reversed. The properties of the sound absorber must therefore be modified according to the orientation, as will be described below.

The modified sound pressure is $$p(x,w)=iw\rho_0 G(x,ys,w)[U_0(S',w)+U_r(A,w)], \quad (6)$$

where $$U_r(A,w)=\int_A u_r(w)dS \quad (7)$$

is the volume velocity of the radiating element and $$U_0(S',w)=\int_{S'} u_0(y,w)dS \quad (8)$$

is the volume velocity of the exposed surface.

The net radiated pressure is zero when the sum of the volume velocities is zero, which gives the condition $$U_r(A,w)=-U_0(S',w). \quad (9)$$

When this condition is satisfied, there is no sound radiated from the region. The condition is on the volume velocities of the radiating element and the vibrating surface. The condition can be applied even when the sound absorber has multiple radiating elements, non-planar elements, or elements of arbitrary orientation.

The surface regions may be chosen so that the vibration is approximately constant across the surface. This may be a more restrictive requirement than the requirement that the regions be small on an acoustic wavelength scale. When the velocity of the radiating element is approximately constant across its surface, we can write $$U_r(A,w)\approx A.u_r(w)=A.T(w).u_0(w). \quad (10)$$

and, when the velocity of the vibrating surface is approximately constant across the region, we can write $$U_0(S',w)\approx S'.u_0(w). \quad (11)$$

We require the transmissibility of the sound absorber to be $$T(\omega)=-\frac{S'}{A}. \quad (12)$$

One key aspect of the current invention is that the transmissibility of the sound absorber is related by the above expression to the exposed area S' of the vibrating region and the area A of the radiating element. The sound absorber must be tuned according to the size of the region and the size of the radiating element.

Figure 4:
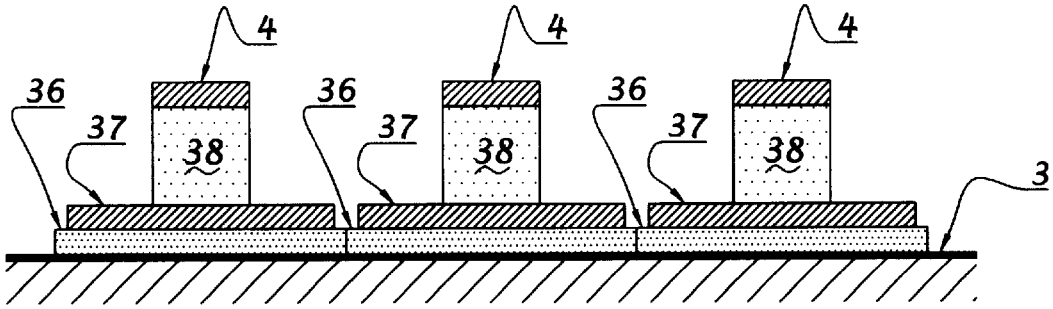
FIG. 4 shows a diagrammatic representation of a third embodiment of the current invention.

When vibration of the surface is not constant over the region, the sound absorber may be coupled to the region at several locations, so that the excitation of the sound absorber approximates the average motion of the region. Alternatively, a mechanical averaging of the surface velocity of the vibrating surface may be used as shown in FIG. 4. In FIG. 4, a compliant layer 36 covers the whole region of the vibrating surface 3. A substantially rigid plate 37 covers the compliant layer 36 and the sound absorber is attached via coupling element 38 to the substantially rigid plate 37. The compliant layer 36 may contain gas filled voids. In this configuration, the compliant layer may act as a vibration isolator, further reducing the level of radiated sound, and very high levels of noise reduction may be achieved. The compliant layer and rigid plate may have a high thermal conductivity, which may be enhanced by placing cooling fins on the surface of the rigid plate. The radiating element 4 is coupled to the rigid plate 37 by additional tuned coupler 38. The sound absorber is tuned so that the volume velocity of the radiating element 4 is substantially equal but opposite to the volume velocity of the rigid plate 37.

In some applications, the vibration pattern of the surface may be relatively fixed. In such cases, there may be regions of the vibrating surface which have little or no vibration. It is not necessary to place sound absorbers on these regions. If the number of sound absorbers is to be minimized, the vibration level of each region may be measured, and sound absorbers placed only on those regions which have significant levels of vibration.

For general application, the placing of the sound absorbers can be determined from the geometry of the vibrating surface. The frequency of the noise may be known in advance, as is the case of power transformers and some generators for example. The tuning of the sound absorbers may also be determined in advance. The locations of the sound absorbers may be chosen so that the region associated with each sound absorber has an area as close as possible to the optimal area. The positions of the sound absorbers may conveniently be determined by entering the dimensions of the vibrating surface into a computer program. The computer program may be accessed via the Internet for example.

The next section consider some examples of coupling elements which can be tuned to provide the desired transmissibility.

Coupling Element

The coupling element 5 in FIGS. 2 and 3 couples the motion of the vibrating surface 3 to the radiating element 4. This is an improvement over the previous methods, where the radiating element was coupled only to the sound field, since the vibration of the surface still drives the radiating element, even when the sound field is cancelled.

We now describe the properties of the coupling element and how they must be chosen for a given application.

The velocity of the vibrating surface at radian frequency w and time t, is written as real $\{u_0 e^{-iwt}\}$, and the velocity of the radiating element as real $\{u_r e^{-iwt}\}$, where $i=\sqrt{-1}$. The coupling element may include various components which can be modeled as springs, masses and dampers. Examples include mechanical springs (wave, leaf, coil etc.), gas springs, magnetic springs and electromagnetic springs. Further examples include bellows couplings and elastomeric coupling with entrapped gas, each of which provides both mechanical spring and gas spring coupling. The velocity of the radiating element is $$u_r = T(w,m)u_0, \tag{13}$$

where T(w,m) is the transmissibility of the coupling element. The transmissibility depends upon the frequency w, the properties of the coupling element and the mass m of the radiating element.

In some applications, the presence of the sound absorber will alter the vibration of the vibrating surface. The original noise source produces a force $f_s$ on this region of the vibrating surface. The net force on this region of the vibrating surface is the sum of the force $f_s$ and the reaction force $-f_0$ due to the sound absorber. The velocity of the vibrating surface is therefore $$u_0 = \frac{1}{Z_s(\omega)}(f_s - f_0), \tag{14}$$

where $Z_s(w)$ is the complex impedance of the vibrating surface. The reaction force is $f_0 = Z_c(w,m)\, u_0$, so the velocity of the vibrating surface is $$u_0 = \frac{f_s}{Z_s(\omega) + Z_c(\omega, m)}. \tag{15}$$

where $Z_c(w,m)$ is the complex impedance of the sound absorber. In many applications $Z_s(w) >> Z_c(w,m)$, so the velocity of the vibrating surface is not changed significantly by the addition of the sound absorber.

For zero sound radiation we can choose T(w,m) such that $$T(\omega, m) = -\frac{S'}{A}. \tag{16}$$

That is, if the ratio of amplitudes of the motion of the radiating surface A and the corresponding region of the vibrating surface is $-S'/A$, the volume velocities thereof are equal but opposite, so that the sound radiated by the vibrating surface is effectively cancelled by that radiated by the radiating surface of the sound absorber of the current invention.

In general, the total volume velocity of the sound absorber must be considered. For example, if an elastomeric coupling element is compressed in one direction it may expand in another, this expansion must be considered if it contributes to the net volume velocity of the sound absorber, and the surface of the elastomeric coupling element constitutes part of the surface of the radiating element.

It may not always be possible to solve the equation exactly. Instead we can seek to minimize the cost function $$J(T(\omega, m)) = \left| T(\omega, m) + \frac{S'}{A} \right| \tag{17}$$

by varying the characteristics of the coupling element and/or the mass m of the radiating element.

If more than one frequency range is to be cancelled by a single sound absorber, the coupling device must have multiple degrees of freedom. This can be achieved, for example, by using a combination of masses and springs in the coupling element.

General System

For a coupler comprising multiple elements and including N mass elements, the equation of motion may be written as $$Z(w)u = f, \tag{18}$$

where $u = \{u_1, u_2, \ldots u_N, u_r\}^T$ is a vector of the velocities of the various mass elements, Z is the complex impedance matrix (which includes spring, mass and damping terms) for the elements coupling the masses and f is the vector of external forces applied to the sound absorber (including forces applied by the vibrating surface). The force vector includes acoustic forces which can sometimes be neglected. Solving for the velocity $u_r$ of the radiating element gives $$u_r = e^T Z(w)^{-1} f, \tag{19}$$

where all of the elements of the vector e are zero apart from the element in the last position, which is unity (i.e. $e_j = \delta_{j,N+1}$, where δ is the Kronecker delta). When external acoustic coupling forces are neglected, the velocity of the radiating element is $$u_r = -iwe^T Z(W)^{-1} k u_0, \tag{20}$$

where k is the vector stiffness for the elements connecting masses directly to the vibrating surface. The transmissibility is therefore $$T(w,m) = -iwe^T Z(w)^{-1} k. \tag{21}$$

By way of example, we now consider some particular embodiments.

Simple Spring/Damper

Figure 5:
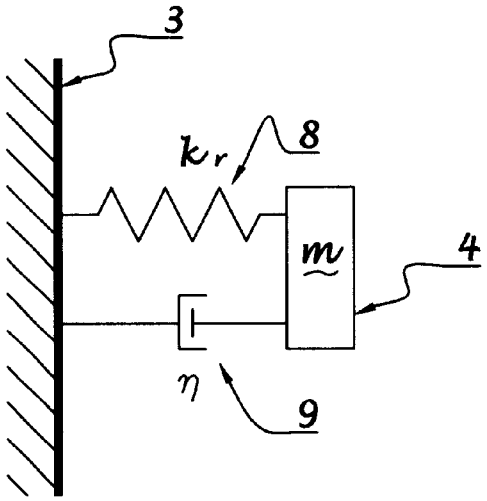
FIG. 5 is an equivalent network representation of the first embodiment of a sound absorber of the current invention.

A simple spring/damper coupler is shown schematically in FIG. 5. The transmissibility is $$T(\omega, m) = \frac{k}{k - \omega^2 m}, \tag{22}$$

where the coupler parameter $k = k_r + iw\eta$ describes the characteristics of the coupler, $k_r$ is the stiffness of spring 8, η is the damping coefficient of viscous damper 9 and m is the mass of the radiating element 4. The spring stiffness includes the stiffness of any fluid in the coupling element and the stiffness of any acoustic seals. For a given frequency, w, the coupler parameter k and the mass m of the radiating element can be chosen so that the sound absorber cancels the radiated noise. For a radiating element of mass m, we require $$k = \frac{\omega^2 m S'}{(A + S')}. \tag{23}$$

This can only be solved exactly if η=0. Low levels of damping are therefore required for good noise reduction in this embodiment.

For a fixed mass, the stiffness must be varied according to the frequency of the noise. The sound absorber can be made adaptive if a measurement of the frequency w is available, by varying k according to the above equation.

For a lightly damped system, the resonance frequency $w_r$ of this system is $$\omega_r = \sqrt{\frac{k_r}{m}}, \tag{24}$$

whereas the noise reduction occurs at $$\omega = \sqrt{\frac{k_r}{m}\frac{(A + S')}{S'}} = \omega_r \sqrt{\frac{A + S'}{S'}}. \tag{25}$$

The system therefore operates above the resonance frequency of the sound absorber. This is in contrast to prior sound and vibration absorber systems, which operate at the resonance frequency.

Figure 6:
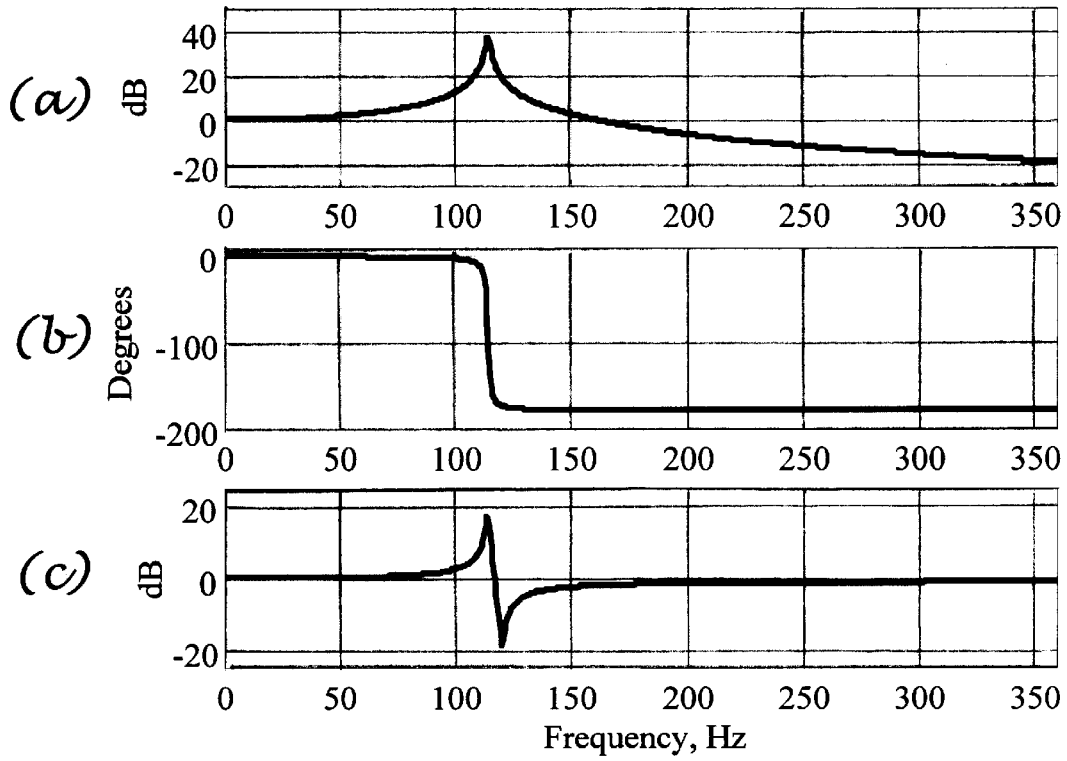
FIG. 6 shows a series of graphs showing the performance of the first embodiment of the current invention.

FIG. 6 shows a typical response of this sound absorber. FIG. 6*a* shows the magnitude of the transmissibility in decibels. FIG. 6*b* shows the corresponding phase. FIG. 6*c* shows the resulting radiation efficiency of the vibrating surface in decibels relative to the radiation efficiency without the sound absorbers, plotted as a function of frequency in cycles per second. At the resonance frequency, the sound radiation is increased, but at the design frequency of 120 Hz the radiation is significantly reduced. Many industrial machines, including power transformers, rotating machines and reciprocating machines, generated sound at discrete frequencies. The sound absorber may be tuned so that the resonance peak shown in FIG. 6*c* is at a frequency where little or no noise is generated.

For an inward facing radiating element, the transmissibility is $$T(\omega, m) = -\frac{k}{k - \omega^2 m}, \tag{26}$$

so we require $$k = \frac{\omega^2 m S'}{S' - A}. \tag{27}$$

This gives $$\omega = \omega_r \sqrt{\frac{S' - A}{S'}}, \tag{28}$$

so the cancellation occurs below the resonance frequency of the system.

Figure 7:
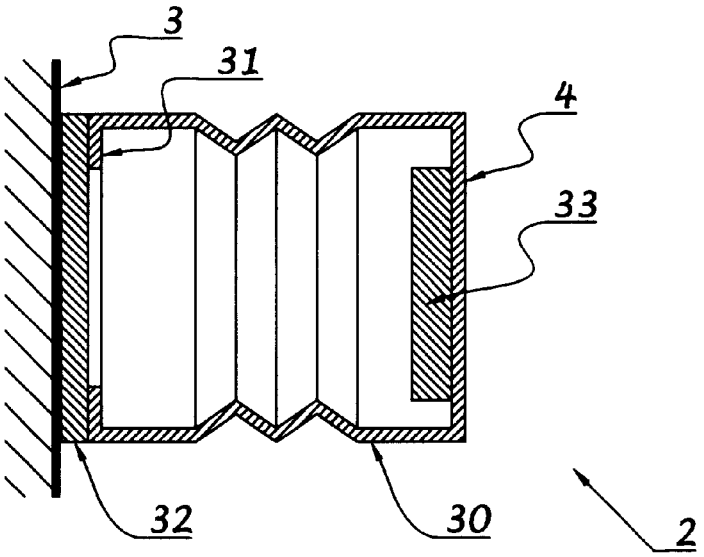
FIG. 7 shows a fourth embodiment of the current invention incorporating a bellows structure.

An example of a sound absorber where the coupling element can be modeled as a spring is shown in FIG. 7. A bellows structure 30 forms a flexible coupling element. The end of the bellows structure 30 is closed to form a radiating surface 4 . The fluid trapped inside the bellows structure 30 forms a fluid spring which acts in parallel with the mechanical spring of the bellows structure. The bellows structure 30 is attached via flanges 31 to one surface of a permanent magnet 32, thereby forming an acoustically sealed volume. The permanent magnet 32.provides the means for attaching the whole sound absorber 2 to the vibrating surface 3. The tuning of the sound absorber 2 is achieved by attaching a mass 33 to the inside or outside of the radiating surface 4.

Figure 8:
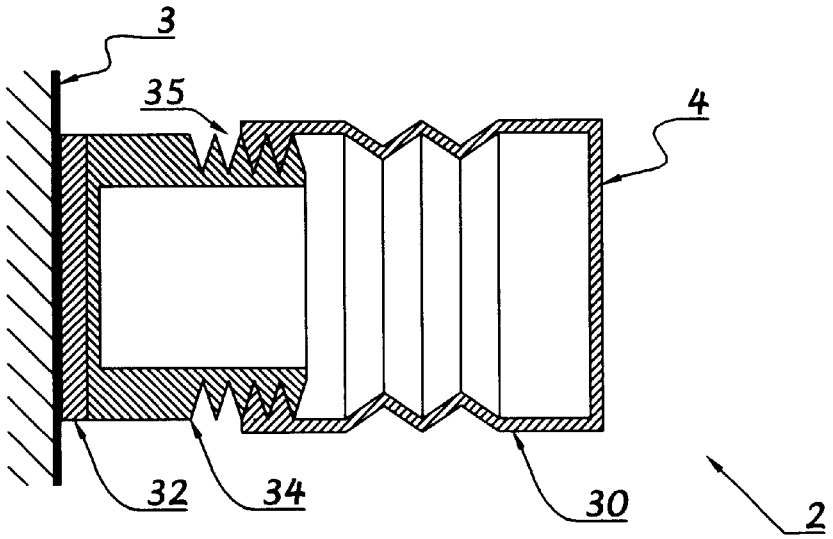
FIG. 8 shows a fifth embodiment of the current invention incorporating a bellows structure and a screw tuning mechanism.

In a further embodiment shown in FIG. 8, a bellows structure 30 forms a flexible coupling element. The end of the bellows structure 30 is closed to form a radiating surface 4. The open end of the bellows structure is threaded over (or into) thread 35 of the housing 34, thereby forming an acoustically sealed volume. The fluid trapped inside this volume forms a fluid spring which acts in parallel with the mechanical spring of the bellows structure. The housing 34 is attached to one surface of a permanent magnet 32. The permanent magnet 32 provides the means for attaching the whole sound absorber 2 to the vibrating surface 3. The tuning of the sound absorber 2 is achieved by rotating the bellows structure 30 relative to the housing 34 and thereby adjusting the volume of fluid in the enclosed volume. This in turn alters the spring constant of the fluid spring.

In FIGS. 7 and 8 a permanent magnet is used to attach the sound absorber to the vibrating surface. A variety of alternative attachment means will be apparent to those skilled in the art, including welding, bolting, riveting, gluing, use of surface mounted studs, etc.

Fourth Order System

Figure 9:
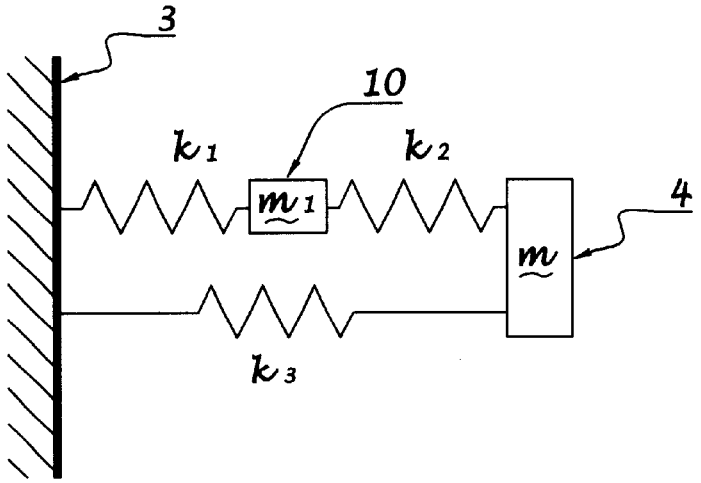
FIG. 9 is an equivalent network representation of a sixth embodiment of a sound absorber of the current invention.

A fourth order sound absorber is shown schematically in FIG. 9. The coupling element includes an intermediate element 10 with mass $m_1$ and three coupling elements that can be modeled as springs. The springs have stiffness coefficients $k_1$, $k_2$ and $k_3$. In practice, most springs have some internal damping, so the stiffness coefficients are considered to be complex. The parameter matrices for this system are $$-i\omega Z = \begin{bmatrix} k_1 + k_2 & -k_2 \\ -k_2 & k_2 + k_3 \end{bmatrix} - \omega^2 \begin{bmatrix} m_1 & 0 \\ 0 & m \end{bmatrix}, k = \frac{i}{\omega}\begin{bmatrix} k_1 \\ k_3 \end{bmatrix}. \quad (29)$$

The transmissibility is $$T(\omega, m) = \frac{k_1 k_2 + k_3(k_1 + k_2 - \omega^2 m_1)}{(k_1 + k_2 - \omega^2 m_1)(k_2 + k_3 - \omega^2 m) - k_2^2}. \quad (30)$$

The coupler parameters, $k_1$, $k_2$, $k_3$ and $m_1$, and the mass m of the radiating element can be adjusted so as to minimize J(T(w,m)) at two selected frequencies, $w_1$ and $w_2$. This permits the sound absorber to cancel the radiated noise at two prescribed frequencies. In practice the sound absorber will provide reduction in the radiated sound in a range of frequencies around these prescribed frequencies.

Figure 10:
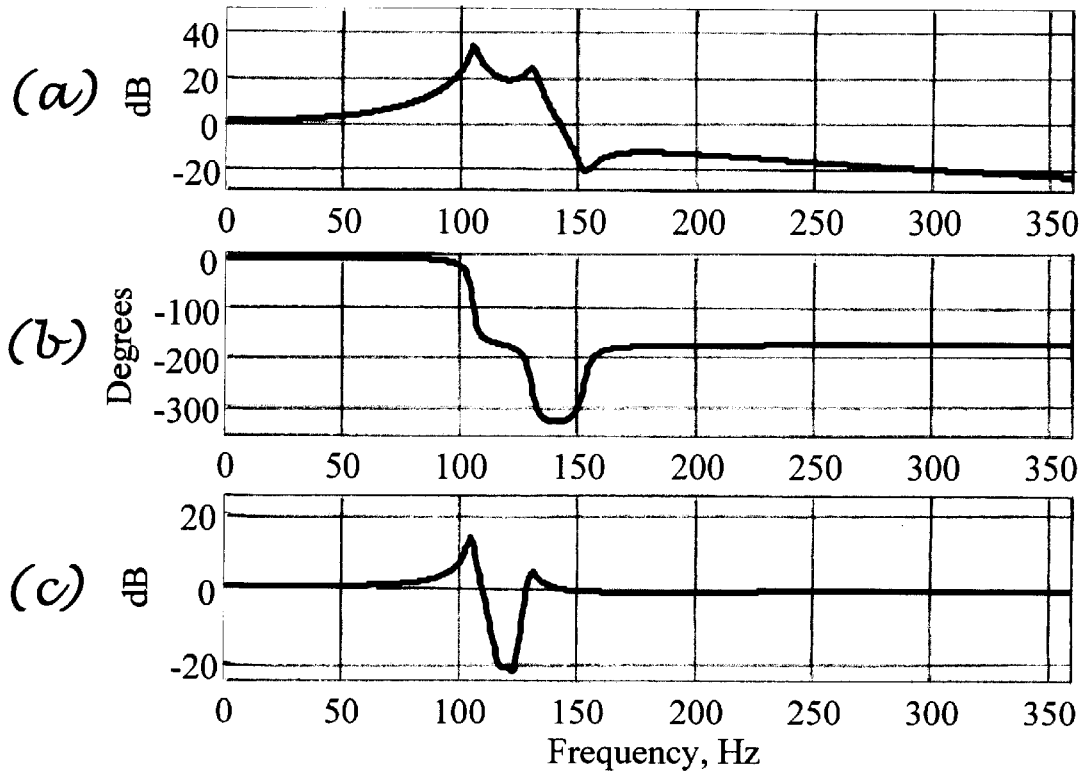
FIG. 10 shows a series of graphs showing the performance of the sixth embodiment of the current invention.

Alternatively, the parameters may be chosen so that $w_1$=$w_2$. This tends to make the sound absorber less sensitive to variations in the coupler parameters. An example of the response of such a system is shown in FIG. 10. FIG. 10*a* shows the magnitude of the transmissibility in decibels, plotted as a function of frequency in cycles per second. FIG. 10*b* shows the corresponding phase. FIG. 10*c* shows the resulting radiation efficiency of the vibrating surface in decibels. At the design frequency of 120 Hz the radiation is significantly reduced. The radiation is also reduced in a small range of frequencies around 120 Hz, indication that the sound absorber is not highly sensitive to parameter values.

Multiple Frequencies

Multiple frequencies can be controlled by using higher order coupling elements, as described above, or by using multiple elements. For example, the sound absorber shown schematically in FIG. 9 may be configured to attenuate sound in two frequency ranges by appropriate choice of the spring constants and masses.

In the preferred embodiment, several sound absorbers can be combined as shown in FIG. 11 for example. In this configuration two second order sound absorbers are combined in a single sound absorber. This sound absorber form a simple module and additional modules may be stacked on top of this module to control multiple frequencies. Preferably, the highest frequency sound absorber is placed closest to the vibrating surface.

Additional higher frequency sound absorbers may be placed on the vibrating surface between combined high/low frequency sound absorbers.

Figure 11A:
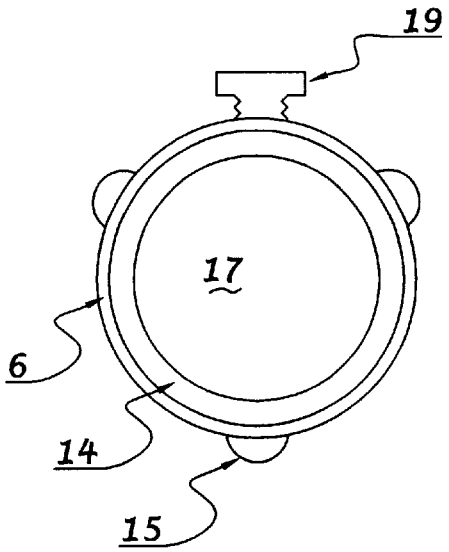
FIGS. 11*a* and 11*b* show a further embodiment of the current invention for reducing radiated sound at multiple frequencies.
Figure 11B:
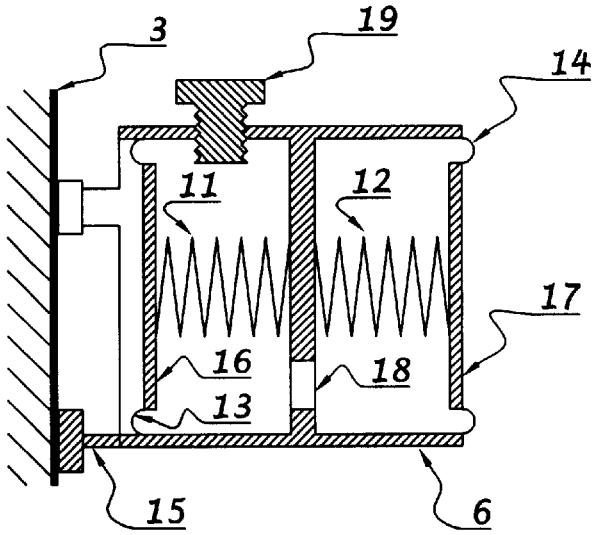

In FIGS. 11*a* and 11*b*, the sound absorbers share a common housing 6 attached to the vibrating surface 3 by standoffs 15. In FIG. 11*b*, the first sound absorber uses a mechanical spring shown schematically as 11, the second sound absorber uses a mechanical spring shown schematically as 12. There are two radiating elements, 16 which faces towards the vibrating surface and 17 which faces away from the surface. The housing 6 is filled with a fluid, such as air, which is prevented from escaping from the housing by acoustic seals 13 and 14. The trapped fluid constitutes a fluid spring which acts on the radiating elements 16 and 17. The stiffness of the fluid spring and the stiffness and damping of the acoustic seals should be included in the design of the sound absorber. In this embodiment the seals 13 and 14 couple the radiating elements to the housing 6. Fluid seals or seals making sliding contact with the housing may also be used. Since fluid springs are used, screw device 19 is incorporated. This can be used to adjust the volume of the fluid enclosed by housing 6, and thereby adjust the characteristics of the fluid spring to compensate for changes in static pressure (such as introduced by altitude or depth changes), or misadjustment of the mechanical springs.

The screw sound absorber may also be coupled with a simple control system to adjust the frequency range of sound reduction.

Each fluid spring may be in separate, acoustically sealed volume, or the sealed volumes may be coupled via aperture 18. A shared volume is advantageous if the overall size of the sound absorber is to be minimized.

The volumes are acoustically sealed, but a small amount of fluid leakage is allowed so as to allow equalization of the static pressures inside and outside of the sound absorber.

Helmholtz Resonator

Figure 12:
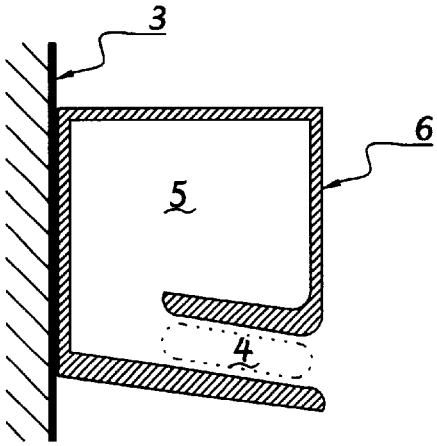
FIG. 12 shows a further embodiment of the current invention incorporating a Helmholtz resonator.

A Helmholtz resonator comprises a volume connected to the atmosphere via a neck as shown in FIG. 12. The air in the neck acts like a single mass and is a radiating element 4. The housing 6 encloses a volume of air 5 which acts like a spring. When the housing is attached to the vibrating surface 3, the volume of air 5 couples the motion of the surface to the air mass 4 in the neck of the resonator. In this case the coupling element contains no mechanical parts. In the preferred embodiment the neck of the resonator is placed at the bottom of the face of the housing and angled slightly downward to prevent water, dirt etc. from collecting inside the resonator. The spring constant is $$k = \rho_0 c^2 \frac{S_n^2}{V}, \quad (31)$$

where $\rho_0$ is the fluid density, c is the sound speed, $S_n$ is the area of the resonator neck and V is the volume of the resonator cavity. The mass of air in the neck is $$m = S_n L \rho_0, \quad (32)$$

where L is the effective length of the neck.

In one embodiment multiple resonators are used, each having an individual housing. In a further embodiment a single large housing contains multiple resonator necks. In either embodiment, the acoustic interaction between the resonators must be considered, since the sound absorber has a low impedance. Since this is a simple mass/spring device, the resulting performance is very similar to that shown in FIG. 6*a*.

In contrast to prior Helmholtz resonator systems, the resonator is rigidly mounted on the vibration surface, so that the fluid mass is driven by the vibration of the surface rather than by the sound. Also, as noted above, the sound absorber operates at a frequency above the resonance frequency of the sound absorber.

Mechanical devices typically have high impedances except when operating close to the resonance frequency. Acoustic interactions may need to be accounted for if the acoustic impedance of the surrounding fluid is comparable with mechanical impedance in the frequency range of interest. It is therefore preferable to design the mechanical impedance of the sound absorber to be high enough that acoustic interactions can be neglected.

Barriers

The vibrating surface may be the surface of a vibrating body, such as a machine, or the surface of a remote body, such as a barrier, enclosure or wall. The remote body is excited by the pressure of an impinging sound wave and is caused to vibrate. Previous schemes have sought to prevent this vibration by increasing the impedance of the remote body. The current invention uses this vibration to excite the radiating elements of sound absorbers. The sound radiated by the radiating elements cancels the sound radiated by the remainder of the vibrating surface.

Figure 13C:
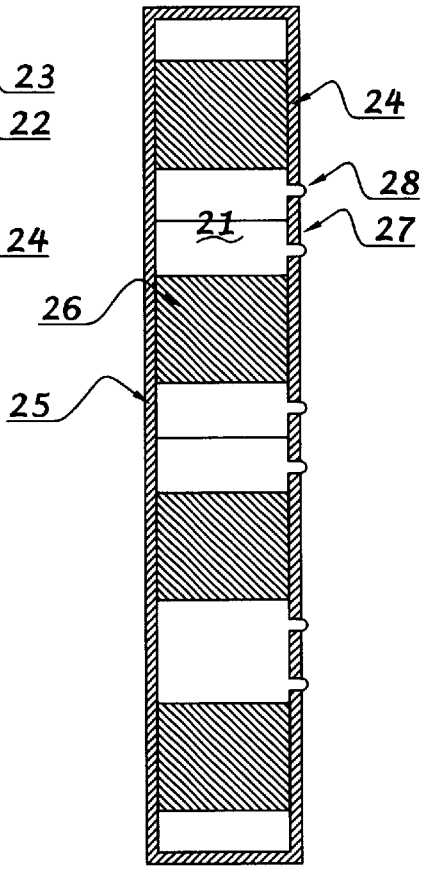
FIGS. 13*a*, and 13*b*, and 13*c* show a noise reduction barrier utilizing the current invention.
Figure 13B:
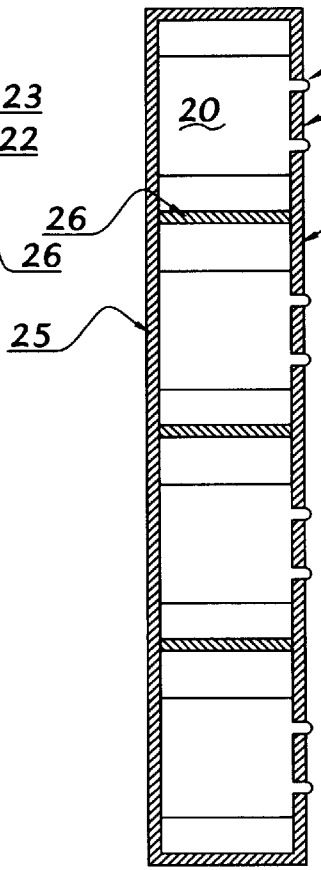
Figure 13A:
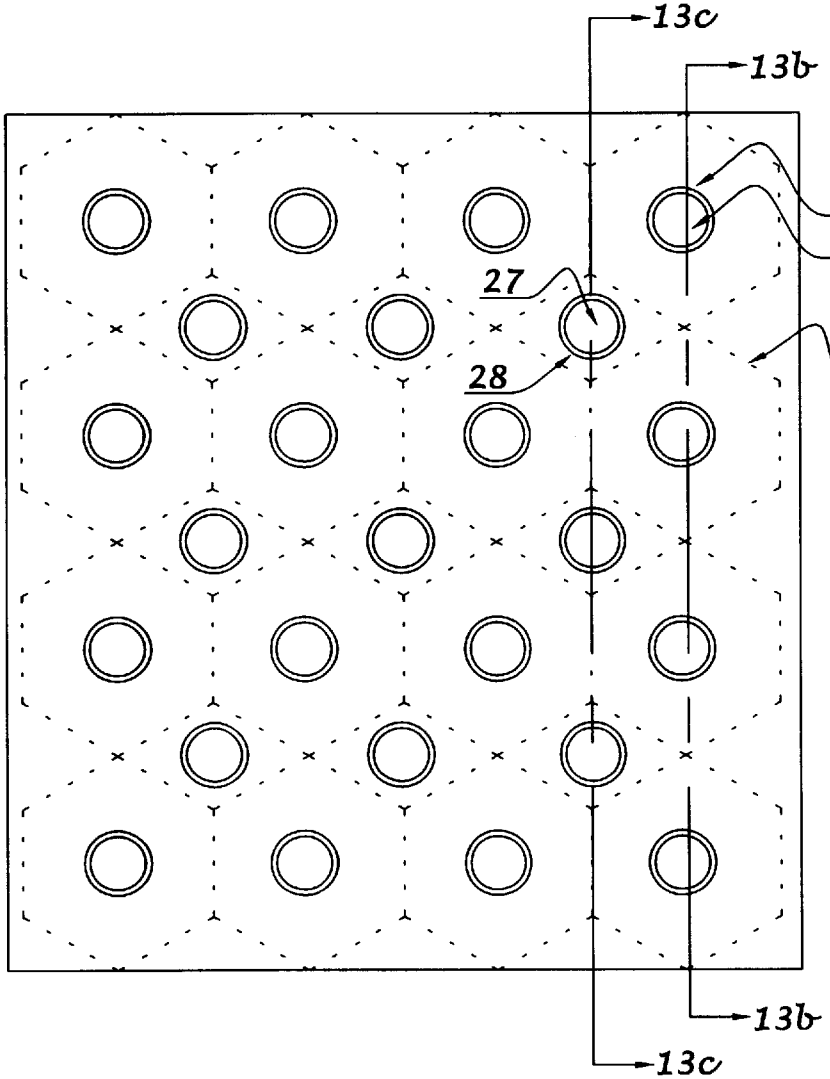

The remote body may take the form of a double-leaf panel as shown in FIGS. 13*a*, 13*b* and 13*c*. FIG. 13*a* shows a panel with a number of sound absorbers. The sound absorbers may be tuned for reducing the sound radiated from the panel in several different frequency ranges. For example, the sound absorber with radiating element 22 and acoustic seal 23 may be tuned to one frequency range, while sound absorber with radiating element 27 and acoustic seal 28 may be tuned for another frequency range. FIGS. 13*b* and 13*c* show cross-sections through the barrier. The two leaves, 24 and 25, are separated by spacing elements 26. These spacing elements are shown by the dashed lines 26 in FIG. 13*a*. The spacing elements rigidly couple the motion of the two leaves. In one embodiment, the spacing elements and the panel form closed volumes, 20 in FIG. 13*b* and 21 in FIG. 13*c*, which constitute air springs coupling the radiating elements, 22 in FIG. 13*b* and 27 in FIG. 13*c*, to the vibration of the panel. The vibration is also coupled through air-seals 23 in FIG. 13*b* and 28 in FIG. 13*c*.

In FIG. 13, the sound absorbers are shown embedded in the vibrating surface, however, they may be placed on the outer surface of the outer leaf 24.

In a further embodiment, the rear panel 25 and spacing elements 26 are replaced by individual housings which form acoustic enclosures behind each radiating element.

Compensation for Environmental Changes

The characteristics of the coupling element may change over time. For example, the various components of the coupling device may be sensitive to temperature, pressure, wear, fatigue, corrosion etc. Most of these effects can be minimized by careful engineering design. However, particularly if very high reduction levels are required, it may be necessary to adjust the properties of one or more of the components to maintain the desired overall characteristic. In other applications, the frequency of the noise may change, requiring a change in the characteristics of the coupling element.

The adaptive tuning of passive elements is well known for vibration absorbers, and many of these techniques may be applied to the sound absorber of the current invention. Examples that use electrical or electronic control systems include U.S. Pat. No. 5,954,169 (Jensen), U.S. Pat. No. 5,924,670 (Bailey et al.), U.S. Pat. No. 5,710,714 (Mercadal et al.), U.S. Pat. No. 6,006,875 (van Namem), U.S. Pat. No. 5,794,909 (Platus et al.), U.S. Pat. No. 5,695,027 (von Flotow et al.), U.S. Pat. No. 5,873,559 (von Flotow et al.).

Adaptive tuning of acoustic systems is also known. Examples include U.S. Pat. No. 5,930,371 (Cheng et al.) and U.S. Pat. No. 5,621,656 (Langley).

A mechanical temperature compensator is disclosed in U.S. Pat. No. 5,924,532 (von Flotow).

While these methods are primarily designed to maintain a vibration absorber operating at a resonance frequency, it will be obvious to those skilled in the art how they could be modified for application to the current invention.

In several embodiments of the current invention, the coupling element includes a fluid spring. The stiffness of this spring can be altered by adjusting the volume of the acoustically sealed cavity. This adjustment can be conveniently achieved by using an element, such as a screw, which passes through the wall of the cavity. An example is shown in FIG. 11*b*. Turning the screw 19 will increase or decrease the amount of screw protruding into the cavity and will therefore decrease or increase the volume of fluid in the cavity. The screw may be turned manually or by a motor or by other convenient means. This mechanism allows the sound absorbers to be fine-tuned, so as to compensate for changes in barometric pressure, for example.

It should be understood that the invention is not limited to the particular embodiments shown and described here, but that various changes and modifications may be made without departing from the spirit and scope of this invention as described in the following claims.

What is claimed is:

1. A vibration excited sound absorber for reducing the sound radiated from a region of a vibrating surface, said region having an area S, and said sound absorber comprising:

a sound radiating element defining a sound radiating surface and a coupling element comprising a member having:

a first surface attachable to a first part of the region of the vibrating surface such that a second part of the region with area S' remains exposed; and a second surface attached to the sound radiating element;

said coupling element being operable to couple motion of the region of the vibrating surface to said sound radiating element, so that the sound radiating element is excited into motion by vibration of the region of the vibrating surface;

wherein the dynamic response of said sound absorber is tuned so that velocity u of the first part of the region of the vibrating surface causes the sound radiating surface to vibrate with a volume velocity of approximately $-S' \times u$ at one or more frequencies.

2. A sound absorber as in claim 1, in which said radiating element forms part of an acoustically sealed volume.

3. A sound absorber as in claim 2 in which said vibrating surface forms one side of said acoustically sealed volume.

4. A sound absorber as in claim 1 and including means for attaching said sound absorber to said vibrating surface.

5. A sound absorber as in claim 1 in which said radiating element is solid and substantially rigid.

6. A sound absorber as in claim 1 in which said radiating element is a fluid mass supported by a fluid spring.

7. A sound absorber as in claim 1 in which said coupling element includes at least one spring.

8. A sound absorber as in claim 1 in which said coupling element has multiple degrees of freedom and said sound absorber is tuned to vibrate with a volume velocity of approximately $-S' \times u$ at each of a plurality of frequencies.

9. A sound absorber as in claim 1 wherein said coupling element member comprises:

a housing for attaching the coupling element to said vibrating surface; and an acoustical seal coupling said housing to said radiating element, wherein said housing, said acoustic seal and said radiating element form an acoustically sealed volume.

10. A sound absorber as in claim 1 further comprises:

one or more spacing elements attached to the first surface of said coupling element member operable to attach the sound absorber to the vibrating surface such that the sound absorber is spaced from the vibrating surface, allowing fluid circulation between the vibrating surface and the sound absorber.

11. A sound absorber as in claim 1 comprising a plurality of sound radiating elements and coupling elements tuned to vibrate with a volume velocity of approximately $-S' \times u$ at a plurality of frequencies.

12. A sound absorber as in claim 1, further comprising a magnet operable to attach the sound absorber to the vibrating surface.

13. A sound absorber for reducing the sound radiated from a region of a vibrating surface, said region having an area S, and said sound absorber comprising:

a sound radiating element with a sound radiating surface positioned in close proximity to or embedded in said vibrating surface and a coupling means coupled to the vibrating surface on one side and to the sound radiating surface on another side, said coupling menas being operable to couple motion of the vibrating surface to the motion of said radiating element, wherein the dynamic response of said sound absorber to said motion of the vibrating surface is tuned so that the volume velocity of said radiating velocity of the corresponding region of the vibrating surface at at least one frequency, and wherein the sound radiating surface of said radiating element is oriented away from said vibrating surface and the ratio of the amplitude of the motion of the radiating element to the amplitude of the motion of the vibrating surface is $-S'/A$, where $S'=S-A$ and A is the area of the radiating element, and A is less than S.

14. A sound absorber for reducing the sound radiated from a region of a vibrating surface, said region having an area S, and said sound absorber comprising:

a sound radiating element with a sound radiating surface positioned in close proximity to or embedded in said vibrating surface; and a coupling means coupled to the vibrating surface on one side and to the sound radiating surface on another side, said coupling means being operable to couple motion of the vibrating surface to the motion of said radiating element, wherein the dynamic response of said sound absorber to said motion of the vibrating surface is tuned so that the volume velocity of said radiating element is substantially equal in amplitude but opposite in phase to the volume velocity of the corresponding region of the vibrating surface at at least one frequency, and wherein the sound radiating surface of said radiating element is oriented towards said vibrating surface and in which the ratio of the motion of the radiating element to the motion of the vibrating surface is $-S'/A$, where $S'=S+A$ and A is the area of the radiating element, and A is less than S.

15. A method for reducing the sound radiated from a vibrating surface, comprising the steps of:

dividing said surface into a number of contiguous first regions;

determining the volume velocity of each first region and thereby determining a number of second regions which significantly contribute to the radiated sound; and attaching a sound absorber to each said number of second regions, said sound absorber comprising a radiating element and a coupling element, the coupling element having first and second surfaces and being attached to the vibrating surface on the first surface and to the radiating element on the second surface and causing the vibration of said second region to be transmitted to said radiating element, wherein said sound absorbers are configured so that a change in volume of the sound absorber is proportional in amplitude but substantially opposite in phase to a displacement of the first surface of the coupling element in a direction normal to the vibrating surface to which the sound absorber is attached.

16. A method for reducing the sound radiated from a vibrating surface, comprising the steps of:

determining the dimensions of said vibrating surface;

computing from said dimensions a set of attachment positions on said vibrating surface;

attaching a sound absorber at each attachment position of said set of attachment positions, said sound absorber comprising a radiating element and a coupling element, the coupling element having first and second surfaces and being attached to the vibrating surface on the first surface and to the radiating element on the second surface and causing the vibration of the vibrating surface at each attachment position to be transmitted to said radiating element; and tuning each said sound absorber so that the radiating element produces a volume velocity proportional equal in amplitude but substantially opposite in phase to the velocity of the first surface of the coupling element in a direction normal to the vibrating surface.

17. A vibration excited sound absorber for reducing the sound radiated from a region of vibrating surface, said region having an area S and said sound absorber comprising:

a body having a sound radiating surface and a coupling surface for attaching the body to a first part of the region of the vibration surface and leaving a second part of the region with area S' exposed, wherein said sound absorber is tuned such that a velocity u of the coupling surface in a direction normal to the region of the vibrating surface causes the sound absorber to generate a volume velocity of approximately $-S'\times u$.

18. A vibration excited sound absorber in accordance with claim 17, wherein said body comprises:

a compliant coupling element providing said coupling surface and a portion of said radiating surface; and a substantially rigid element providing a portion of said radiating element.

19. A vibration excited sound absorber in accordance with claim 18, wherein said compliant coupling element includes at least one of the bellows coupling, an air-spring, a coil spring, a wave spring, a leaf spring, a solid elastomer, an elastomer with fluid-filled voids, a magnetic spring and an electromagnetic spring.

20. A method for reducing the sound radiated from a vibrating surface, comprising the steps of:

determining the dimensions of said vibrating surface;

computing from said dimensions a set of contiguous regions of said vibrating surface; and for each region of the set of contiguous regions:

attaching a sound absorber to a first part of the region such that a second part of the region with area S' is exposed, said sound absorber comprising a body having a sound radiating surface and a coupling surface for attaching the body to the first part of the region of the vibrating surface; and tuning said sound absorber such that a velocity u of the coupling surface in a direction normal to the region of the vibrating surface causes the sound absorber to generate a volume velocity of approximately $-S'\times u$.

21. A method for reducing the sound radiated from a vibrating surface, comprising the steps of:

dividing said surface into a set of contiguous regions of said vibrating surface; and determining the volume velocity of each of the set of contiguous regions and thereby determining a subset of regions which significantly contribute to the radiated sound;

for each region of the subset of regions:

attaching a sound absorber to a first part of the region such that a second part of the region with area S' is exposed, said sound absorber comprising a body having a sound radiating surface and a coupling surface for attaching the body to the first part of the region of the vibration surface; and tuning said sound absorber such that a velocity u of the coupling surface in a direction normal to the region causes the sound absorber to generate a volume velocity of approximately $-S' \times u$.

22. A vibration excited sound absorber for reducing sound radiated from a region of a vibrating surface, said sound absorber comprising:

a compliant layer defining a first surface and second surface, said first surface attachable to said region of the vibrating surface;

a substanially rigid plate having a first side attached to the second surface of said compliant layer and a second side; and a sound absorber body attached to the second side of said substantially rigid plate and leaving an area S' of the second side of said substantially rigid plate exposed, wherein said sound absorber body is tuned such that a velocity u of said substantially rigid plate in direction normal to the second side of the substantially rigid plate causes the sound absorber body to generate a volume velocity of approximately $-S' \times u$.

23. A vibration excited sound absorber as in claim 22, wherein said compliant layer includes an air spring.

* * * * *